US005903208A

United States Patent [19]

Sorger

[11] Patent Number: 5,903,208

[45] Date of Patent: May 11, 1999

[54] STITCHED CORE FUSE

[75] Inventor: Hermann Sorger, Sãao Paula, Brazil

[73] Assignee: Cooper Technologies Company, Houston, Tex.

[21] Appl. No.: 09/129,175

[22] Filed: Aug. 4, 1998

Related U.S. Application Data

[60] Provisional application No. 60/055,034, Aug. 8, 1997.

[51] Int. Cl.[6] ..... H01H 85/06; H01H 85/05; H01H 85/08

[52] U.S. Cl. ..... 337/159; 337/228; 337/158; 337/273

[58] Field of Search ..... 337/31, 290, 158, 337/159, 295, 297, 273, 227, 228, 186

[56] References Cited

U.S. PATENT DOCUMENTS

| | | | |
|---|---|---|---|
| 4,146,861 | 3/1979 | Arikawa et al. | 337/159 |
| 4,237,440 | 12/1980 | Miyasaka et al. | 337/227 |
| 4,563,809 | 1/1986 | Reeder . | |
| 4,656,453 | 4/1987 | Reeder . | |
| 4,680,567 | 7/1987 | Edwards | 337/164 |
| 4,736,180 | 4/1988 | Oh | 337/163 |
| 4,890,380 | 1/1990 | Narancic et al. | 29/623 |
| 4,972,169 | 11/1990 | Kalra | 337/163 |
| 5,109,211 | 4/1992 | Huber | 337/158 |
| 5,142,262 | 8/1992 | Onken | 337/163 |
| 5,245,308 | 9/1993 | Herbias . | |
| 5,345,210 | 9/1994 | Swensen et al. . | |
| 5,361,058 | 11/1994 | Mosesian et al. | 337/158 |
| 5,363,082 | 11/1994 | Gurevich | 337/227 |
| 5,661,628 | 8/1997 | Yamagami | 361/275.4 |
| 5,736,919 | 4/1998 | Reeder | 337/227 |

*Primary Examiner*—Leo P. Picard
*Assistant Examiner*—Anatoly Vortman
*Attorney, Agent, or Firm*—Burns, Doane, Swecker & Mathis, L.L.P.

[57] ABSTRACT

A fuse includes a solid silicone rod that has a fuse element stitched repeatedly through the rod so that the stitches extend longitudinally along the length of the rod. The stitched silicone rod is secured within a fiberglass tube, and a silica sand pulverant is provided around the stitched silicone rod so as to provide further arc quenching capability.

13 Claims, 3 Drawing Sheets

STITCHED CORE FUSE

CROSS-REFERENCE TO RELATED APPLICATIONS

This nonprovisional application claims the benefit of prior filed, copending provisional Application No. 60/055,034, filed on Aug. 8, 1997, the content of which is hereby incorporated herein by reference.

BACKGROUND OF THE APPLICATION

1. Field of the Invention

The present invention relates to a fuse, and more particularly to a medium voltage fuse filled with silica to quench arcs.

2. Description of Related Art

Prior art fuses for medium voltage DC circuits used an epoxy filling around a pyrotechnic fuse wire to quench arcs. However, the process for manufacturing such fuses is complicated because of the use of epoxy. For example, the application of the epoxy required a vacuum chamber to remove air bubbles. Furthermore, the epoxy is difficult to store and clean-up.

Accordingly, other attempts to provide such fuses were sought. In U.S. Pat. No. 5,245,308, a Class L fuse is disclosed wherein flat, plate-like fuse elements 28 are sealed with a silicone rubber material. The entire package is then filled with sand or other pulverant material.

U.S. Pat. No. 5,345,210 discloses a time delay fuse that uses silicone rubber blocks to retain time delay fuse components. In addition, this fuse includes plate-like fuses elements 30 that are surrounded by a pulverant arc quenching material such as sand.

U.S. Pat. Nos. 4,563,809 and 4,656,453 disclose a cartridge fuse having silicone arc quenching end plugs.

Such prior art fuses are either complex to manufacture, or do not provide an adequate length for the fuse element.

OBJECTS AND SUMMARY

It is an object of the present invention to provide a fuse for medium voltage DC applications that provides sufficient arc quenching capability.

It is another object of the present invention to provide a fast acting fuse in a useful package.

One embodiment of the present invention includes a solid silicone rod that has a fuse wire stitched repeatedly through the rod so that the stitches extend longitudinally along the length of the rod. The stitched silicone rod is secured within a fiberglass tube, and a silica sand pulverant is provided around the stitched silicone rod so as to provide further arc quenching capability.

DETAILED DESCRIPTION OF THE PREFERRED EMBODIMENTS

Figure 1:
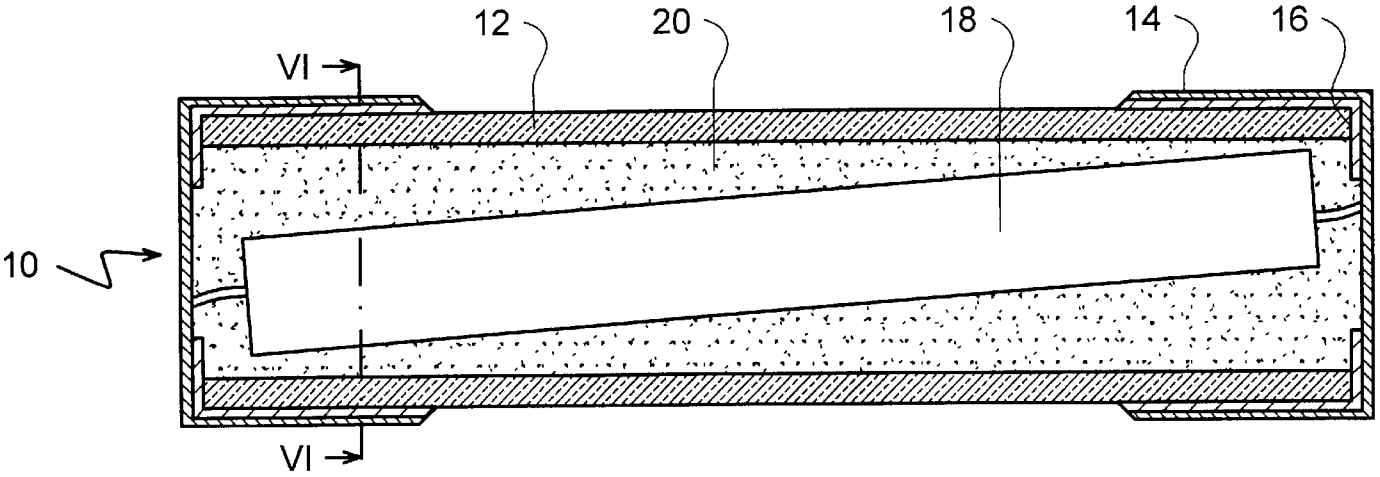
FIG. 1 is a cross-sectional view of a fuse of the present invention.

FIGS. 1–6 illustrate a preferred embodiment of the present invention. In particular, FIG. 1 is a cross-sectional view of a fuse 10 manufactured in accordance with the present invention. The fuse 10 includes a fiberglass tube 12 that is preferably about 125.5 mm in length and about 19.8 mm in diameter (outside diameter). The fuse of the present invention can be up to 70% shorter than conventional fuses of the same voltage rating, and may have an almost unlimited breaking capacity. The fuse of the present invention is well adapted for a fast acting fuse.

Within the fiberglass tube 12 is a silicone rod 18. The silicone rod is preferably about 103 mm in length and about 8 mm in diameter. See FIGS. 2 and 3. In the preferred embodiment, the silicone rod 18 is made of SILASTIC GP-45 silicone rubber, produced by Dow Corning. However, any plastic or similar material that can withstand temperatures of 200° C. may be used instead of silicone rubber.

Another material that can be used for the silicone rod 18 is Kalrez, which is made from DuPont and is capable of withstanding 316° C.

Figure 2:
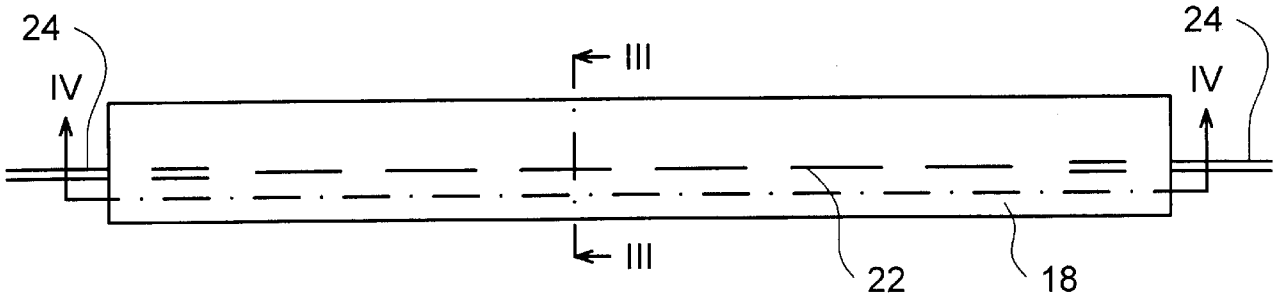
FIG. 2 is a side-elevational view of the stitched silicone rod of the present invention.
Figure 3:
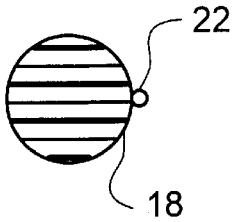
FIG. 3 is a cross-sectional view taken along line III—III of FIG. 2.
Figure 4:
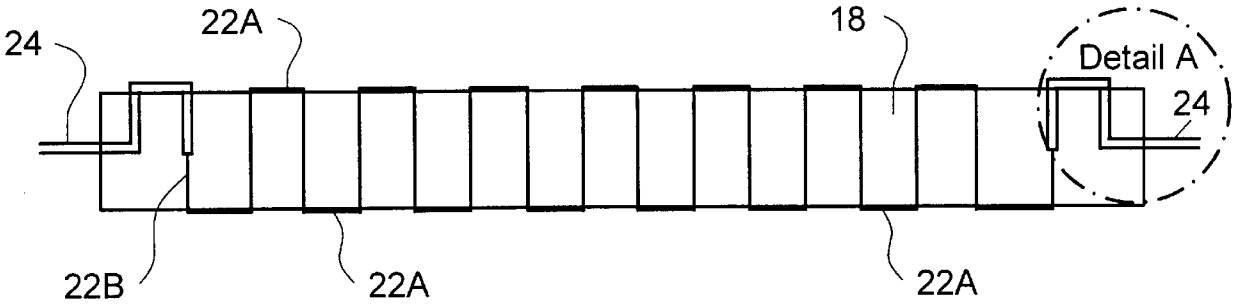
FIG. 4 is a cross-sectional view taken along line IV—IV of FIG. 2.

As illustrated in FIGS. 2 and 4, a fuse element 22 is stitched through the silicone rod 18. The fuse element 22 is stitched radially through the silicone rod repeatedly so that the fuse element 22 extends from one end of the rod to the other end of the rod. According to the embodiment illustrated in FIGS. 1–6, and in particular, as may be best seen in FIG. 4, there are 16 segments or portions 22B of the fuse element 22 that extend radially through the silicone rod 18. In addition, there are 15 segments 22A that extend along an outside surface of the silicone rod 18.

By stitching the fuse element 22 through the silicone rod 18, the fuse 10 can accommodate a significantly longer fuse element 22, than if the fuse element extended directly from one end of the fuse to another. Being able to accommodate a sufficiently long length of fuse element is advantageous in a medium voltage application, such as which may be used with the present invention.

In a preferred embodiment, the fuse element 22 is preferably round and may be comprised of a silver wire having a diameter of 0.3 mm. According to this embodiment, the fuse is capable of handling 7,000 volts DC and carrying 8 amps. This embodiment would also have an interruption rating of 20,000 amps.

The fuse element 22 can alternatively be made of copper or gold, or any other suitable material, preferably having a maximum cross sectional area of 0.0706 square millimeters, or equal to a diameter of 0.3 mm. If the fuse element 22 is significantly thicker than 0.3 mm in diameter, it may build metal drops when it evaporates, which may influence the opening of the fuse. For large current applications, a plurality of parallel, silicone rods may be used, each having a separate fuse element.

Figure 5:
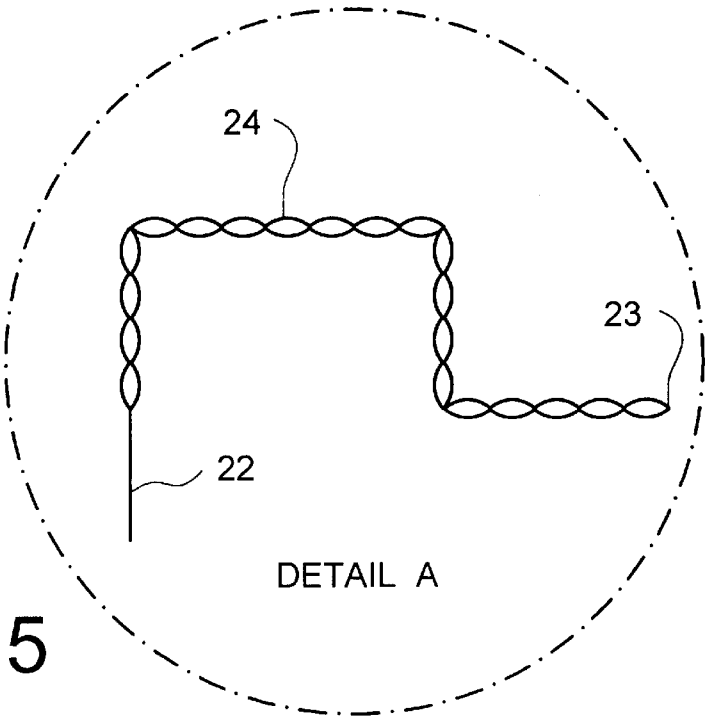
FIG. 5 is an enlarged detail view of a portion of FIG. 4.
Figure 6:
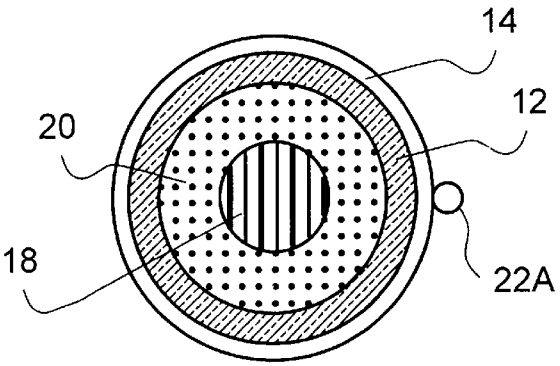
FIG. 6 is a cross-sectional view taken along line VI—VI of FIG. 1.

As illustrated in FIG. 5, each end of the fuse element 22 is folded back at point 23 and braided back on itself as illustrated by reference numeral 24 so as to form a thickened portion of the fuse element at each end thereof. The thickened portion 24 is to ensure that if the fuse is blown, that the fuse will blow at a central portion thereof, and not at one of the ends.

The ends 24 of the fuse element 22 are secured between an end washer 16 and a brass outer cap 14 to secure the fuse element 22 within the fiberglass tube 12. To further secure the silicone rod 18 and fuse element 22 within the fiberglass tube 12, a silica sand or other pulverant material is filled within the fiberglass tube 12 around the silicone rod 18. The sand 20 not only supports the silicone rod 18, but also functions as an arc quenching medium.

The silica sand 20 preferably has a size 20 to 40 mesh. However, other pulverant materials may be used instead of the silica sand or silica sand of a different mesh may also be used.

As illustrated in FIG. 1, the outer brass cap 14 preferably extends along the fiberglass tube 12 for a distance of about 12.7 mm.

The inner diameter of the fiberglass tube 12 is approximately 15.87 mm and the outer diameter of the brass cap 12 is about 20.64 mm ±0.2 mm.

In addition to the preferred embodiment set forth above, other materials may be contemplated by those of ordinary skill in the art. For example, the silicone tube 18 may be of another size and shape, or may be constructed from a material other than silicone, provided that the material is capable of providing some arc quenching capability.

In addition, the fuse element 22 is not limited to the silver wire disclosed above. One of ordinary skill in the art would be able to find numerous substitutes for the size and material from which the fuse element 22 is constructed.

A fuse according to the present invention will open very quickly under a short circuit current. However, the fuse may not open at all when the circuit is charged with an asymmetric overload current of less than 30 milliseconds. This feature is available because the fuse element 22 is kept cool by the silicone rod 18.

The fuse of the present invention is particularly suited for currents ranging from 0.5 through 20 amps, and voltages up to 14 KV. An approximate guideline for the length of the silicone rod 18 is set out in the following table.

Length of silicone rod 18 per voltage

| length mm | 15 | 30 | 40 | 50 | 60 | 85 | 90 | 100 |
|---|---|---|---|---|---|---|---|---|
| KV AC | 0.5 | 1.0 | 3.0 | 5.0 | 7.0 | 9.0 | 11.0 | 14.0 |
| KV DC | 0.25 | 0.5 | 1.5 | 2.5 | 3.5 | 4.5 | 5.5 | 7.0 |

Figure 7A:
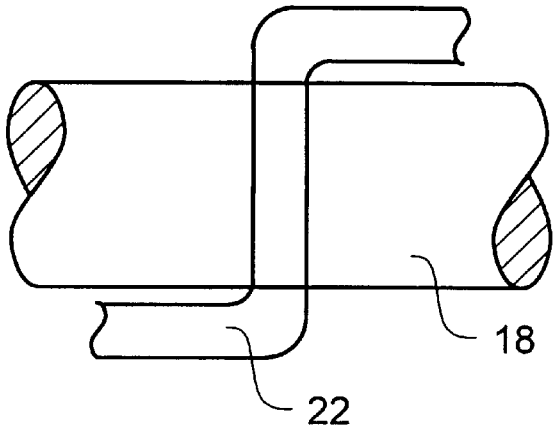
FIGS. 7*a, b*, and *c* illustrate a sequence occurring during melting of the fuse element.
Figure 7B:
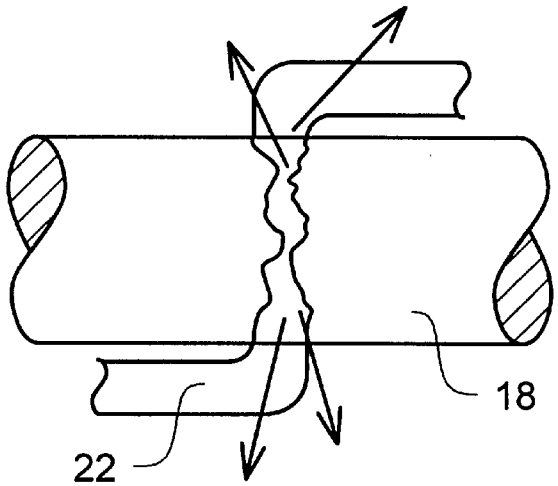
Figure 7C:
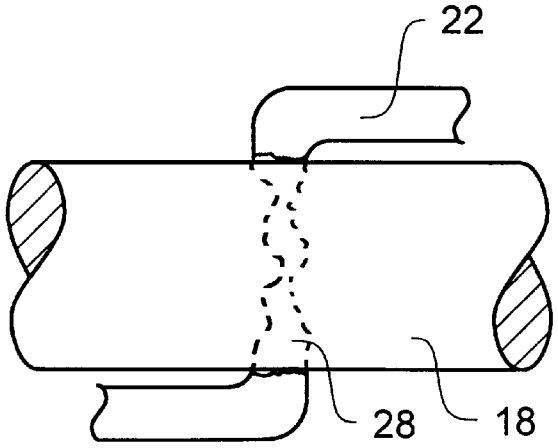

FIG. 7(*a*) illustrates a portion of the fuse element 22 extending through the silicone rod 18 in a premelted condition. FIG. 7(*b*) illustrates the fuse element 22 melting during, for example, a short circuit situation. The fuse element 22 is under a high pressure created by the silicone rod 18. The silicone rod 18 acts to push the molten pieces of the fuse element 22 into the arc quenching material 20. As can be seen in FIG. 7(*c*), after the fuse element 22 melts, the opening 28 in the silicone rod 18 that accommodated the fuse element 22 recloses. The reclosing of the opening 28 in the silicone rod 18 prevents the newly formed ends of the fuse element 22 from rejoining each other.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A fuse comprising:

an insulative rod; and a fuse element stitched through the insulative rod so that a portion of the fuse element extends through the insulative rod.

2. The fuse of claim 1, wherein a second portion of the fuse element is external of the insulative rod.

3. The fuse of claim 1, wherein the silicone rod is elongated in an axial direction and a portion of the fuse element extends through the insulative rod in a radial direction.

4. The fuse of claim 1, wherein the insulative rod is enclosed within a tubular housing.

5. The fuse of claim 4, further comprising an arc quenching material in the tubular housing surrounding the insulative rod.

6. The fuse of claim 4, wherein the insulative rod is silicone.

7. A fuse comprising:

a tubular housing;

an elongated plastic rod extending within the tubular housing;

a fuse element entering the tubular housing at one end thereof and exiting the tubular housing at an opposite end thereof; and the fuse element is stitched repeatedly through the plastic rod so that a portion of the fuse element is within the plastic rod.

8. The fuse of claim 7, wherein at least a portion of the fuse element extends through the plastic rod in a radial direction.

9. The fuse element of claim 8, wherein the plastic rod is made of silicone.

10. The fuse of claim 7, wherein the fuse element includes a plurality of sections, wherein a portion of the sections are internal to the plastic rod and a remainder of the sections are external to the plastic rod.

11. The fuse of claim 7, further comprising an arc quenching material in the tubular housing surrounding the silicone rod.

12. The fuse of claim 7, wherein the plastic material can withstand a temperature of at least 200° C.

13. A fuse comprising:

a tubular housing;

an elongated silicone rod extending within the tubular housing;

a fuse element having a diameter of about 0.3 mm entering the tubular housing at one end thereof and exiting the tubular housing at an opposite end thereof;

a quenching medium is located within the tubular housing surrounding the elongated silicone rod; and the fuse element is stitched repeatedly in a radial direction through the plastic rod so that a portion of the fuse element is within the plastic rod.

* * * * *